US005093014A

United States Patent [19]

Neillie

[11] Patent Number: 5,093,014

[45] Date of Patent: Mar. 3, 1992

[54] FABRIC TREATMENT COMPOSITION AND THE PREPARATION THEREOF

[75] Inventor: William F. S. Neillie, Caldy, Great Britain

[73] Assignee: Lever Brothers Company, Division of Conopco, Inc., New York, N.Y.

[21] Appl. No.: 300,631

[22] Filed: Jan. 23, 1989

[30] Foreign Application Priority Data

Jan. 28, 1988 [GB] United Kingdom ..... 8801861
Jan. 28, 1988 [GB] United Kingdom ..... 8801905

[51] Int. Cl.[5] ..... D06M 13/46; C11D 1/90; C11D 3/33

[52] U.S. Cl. ..... 252/8.8; 252/8.6; 252/8.9

[58] Field of Search ..... 252/8.8, 8.75, 8.9

[56] References Cited

U.S. PATENT DOCUMENTS 3,555,041 1/1971 Katz ..... 8/94.1 R
3,959,157 5/1976 Inamorato ..... 252/8.8
3,984,335 10/1976 Ciko et al. ..... 252/8.6
4,476,030 10/1984 May et al. ..... 252/8.8
4,627,925 12/1986 Butterworth et al. ..... 252/8.8
4,661,269 4/1987 Trinh et al. ..... 252/8.8
4,661,270 4/1987 Grandmaire et al. ..... 252/8.8

FOREIGN PATENT DOCUMENTS 0239910 7/1987 European Pat. Off. .
1247430 4/1970 United Kingdom .
1260584 1/1972 United Kingdom .

OTHER PUBLICATIONS

Literature relating to Neodol-type nonionic surfactants.
Page from "The Condensed Encyclopedia of Surfactants" containing a brief description of Tergitol 15-S-9.

*Primary Examiner*—A. Lionel Clingman
*Attorney, Agent, or Firm*—Ronald A. Koatz

[57] ABSTRACT

A fabric treatment composition comprising an aqueous base, one or more water-soluble amphoteric fabric conditioning materials and a co-active material having an HLB of between 10.0 and 12.0. The weight ratio of amphoteric material to co-active being from 5:1 to 50:1. The amphoteric material is preferably an amine oxide. The composition may also comprise from 1-75% of a water-insoluble cationic fabric treatment compositions.

9 Claims, No Drawings

FABRIC TREATMENT COMPOSITION AND THE PREPARATION THEREOF

This invention relates to a fabric treatment composition and a process for the preparation thereof. In particular it relates to an aqueous liquid fabric softening composition, which comprises an amphoteric material as the active ingredient and which is intended for addition to the rinse step of a fabric laundering process, and a process for the preparation thereof.

British Patent Specification No 1 260 584 (ARMOUR) discloses a method of softening fabrics by the use of a composition containing a quaternary ammonium compound and a tertiary amine oxide. The use of the amine oxide in addition to the quaternary ammonium compound leads to a number of advantages including improved performance in the presence of anionic surfactants, which can be carried over from the wash step in a fabric laundering process. GB 1 260 584 teaches that the two active ingredients may be blended together and then added to the rinse cycle of a fabric laundering process.

We have found that it is not possible to prepare a stable aqueous liquid composition containing amine oxide as the active ingredient simply by dispersing the amine oxide in water. Dispersions made by this method separate into distinct phases in less than 24 hours. Such dispersions can be made stable by the inclusion therein of high levels of a solvent such as isopropanol. However, such high solvent levels may not be desired. They present handling problems, introduce a potential fire risk and may mask or otherwise adulterate the odour of any perfume contained in the product.

We have now surprisingly discovered that stable aqueous fabric treatment compositions containing amine oxides, can be prepared by inclusion in the dispersion of amine oxides a selected range of coactives. Also we have surprisingly found that such stable fabric treatment compositions can also be obtained by the use of other water insoluble amphoteric fabric conditioning materials, in combination with these selected coactives.

In particular it has been found that by using a coactive material of specific HLB (hydrophilic lipohilic balance). Such stable fabric treatment compositions can be obtained.

Therefore the invention is related to a fabric treatment composition comprising an aqueous base, one or more water insoluble amphoteric fabric conditioning materials and a coactive material having an HLB of between 10.0 and 12.0. The weight ratio of amphoteric material to the coactive being from 5:1 to 50:1.

The amphoteric fabric conditioning material

The amphoteric fabric conditioning material for use in a composition according to the invention should be a fabric substantive amphotheric material. Suitable amphoteric materials form a particulate dispersion at a concentration of less than 1 g/l at at least one temperature between 0° and 100° C. For the purpose of this invention a fabric substantive amphoteric material is preferably an amphoteric or zwitterionic tertiary or quaternary ammonium compound having either one single very long hydrocarbyl side chain or two long hydrocarbyl chains. From these compounds the use of amphoteric or zwitterionic ammonium compounds having two long hydrocarbyl chains is particularly preferred for many reasons including costs, ease of processing and better stability and performance.

It is all-ready known, for instance from U.S. Pat. No. 3,984,335 (BASF company) to use a fatty amphoteric compound having one long hydrocarbyl chain in liquid fabric softening components. Single very long chain amphoteric or zwitterionic materials as used in compositions according to the invention are however clearly distinctive over these materials in that the very long hydrocarbyl chain contains a substantial higher amount of C-atoms. For the purpose of the invention this single very long hydrocarbyl chain contains preferably from 16–50 C-atoms, more preferred from 22–50 C-atoms, particularly preferred from 24 to 40 C-atoms.

Amphoteric or zwitterionic ammonium compounds preferably have two long hydrocarbyl chains, each chain having 8–24 C-atoms, preferably 10–20 C-atoms, most preferred around 16 C-atoms.

In this specification the expression hydrocarbyl chain refers to linear or branched alkyl or alkenyl chains optionally substituted or interrupted by functional groups such as —OH,—O—,—CONH—,—COO—,etc.

Suitable amphoteric fabric substantive materials for use in a fabric treatment composition according to the invention are for.instance:

I) Ampholytes of the following formula:

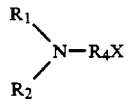

II) Hydrocarbyl betaines of the following formula:

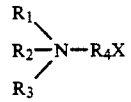

III) Hydrocarbylamido betaines of the following formula:

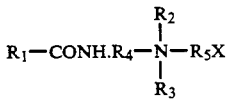

IV) Glycinates or propionates of the following formula:

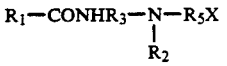

or

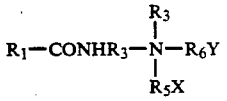

V) tertiary amine oxides of the following formula

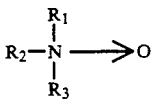

wherein:

a) $R_1$ and $R_2$ are $C_{8-25}$ hydrocarbyl chains, $R_3$ is an hydrocarbyl group containing 1–4 carbon atoms or a group $-(CH_2CH_2O)_nH$, $R_4$, $R_5$, $R_6$ are $-(CH_2)_n-$, which can be interrupted with —O—,—CONH—,—COO— etc, n is an integer from 1–6, X, Y are $SO_3^-$, $SO_4^{2-}$ $COO^-$; or b) $R_1$ is a $C_{16-50}$ hydrocarbyl chain, $R_2$, $R_3$ are hydrocarbyl groups containing 1–4 carbon atoms or a group $-(CH_2CH_2O)_nH$, $R_4$, $R_5$, $R_6$ are $-(CH_2)n-$ which can be interrupted by —O—, —COHN—, —COO— etc, n is an integer from 1–6, X, Y are $SO_3^-$, $SO_4^{2-}$ or $COO^-$.

Preferably the amphoteric fabric substantive materials are water insoluble and have a solubility in water at pH 2.5 at 20° C. of less than 10 g/l. The HLB of the amphoteric fabric substantive material is preferably less than 10.0.

Examples of amphoteric materials of the above groups are the following:

Group i:

(1) $R_1$ and $R_2$ being tallow, $R_4$ being $-(CH_2)_2-$, X being $-COO^-$ (2) $R_1$ and $R_2$ being hardened tallow, $R_3$ being $(CH_2)_2$, X being $-COO^-$ (3) $R_1$ and $R_2$ being coco, $R_4$ being $-(CH_2)_3-$, X being $SO_3^-$ (4) $R_1$ and $R_2$ being stearyl, $R_4$ being $-(CH_2)_3^-$ X being $SO_4^{2-}$ (5) $R_1$ being $C_{26}$ alkyl, $R_2$ being ethyl, $R_4$ being $-(CH_2)_2-$, X being $-COO^-$ (6) $R_1$, being $C_{26}$ alkyl, $R_2$ being methyl, $R_4$ being $-(CH_2)_3-$, X being $SO_3^-$ Group ii:

(7) $R_1$ and $R_2$ being tallow, $R_3$ being methyl, $R_4$ being $-(CH_2)_2-$, X being $-COO^-$ (8) $R_1$ being $C_{30}$ alkyl, $R_2$, $R_3$ being methyl, $R_4$ being $-(CH_2)_2^-$, X being $-COO^-$ Group iii:

(9) $R_1$ and $R_2$ being tallow, $R_{4,5}$ being$-(CH_2)_2-$, $R_3$ being methyl, X being $-COO^-$

(10) $R_1$ and $R_2$ being coco, $R_{4,5}$ being $-(CH_2)_2-$, $R_3$ being methyl, X being $SO_3^-$

(11) $R_1$ being $C_{26}$ alkyl, $R_{2,3}$ being methyl, $R_{4,5}$ being $-(CH_2)_2-$, X being $-COO^-$ Group iv:

(12) $R_1$ and $R_2$ being hardened tallow, $R_5$ being $-(CH_2)_2-$, X being $SO_4^{2-}$

(13) $R_1$ being $C_{26}$ alkyl, $R_3$ being methyl, $R_{5,6}$ being $-(CH_2)_2-$, X, Y being $SO_3^-$ Group v:

(14) $R_1$ and $R_2$ being hardened tallow, $R_3$ being methyl

(15) $R_1$ and $R_2$ being tallow, $R_3$ being methyl

(16) $R_1$ and $R_2$ being stearyl, $R_3$ being methyl

(17) $R_1$ and $R_2$ being coco, $R_3$ being methyl

(18) $R_1$ and $R_2$ being $CH_3$ $(CH_2)_{14}$ COO—, $R_3$ being ethyl

(19) $R_1$ and $R_3$ being $CH_3(CH_2)_{12}$ $COO(CH_2)_2-$, $R_2$ being methyl

(20) $R_1$ being $C_{26}$ alkyl, $R_3$ being $(CH_2CH_2O)_2H$, $R_2$ being methyl

(21) $R_1$ being $C_{24}$ alkyl, $R_{2,3}$ being methyl.

From the above listed materials, particularly the group V materials are preferred, especially those amine oxides containing two hydrocarbyl groups with at least 14C-atoms.

The level of amphoteric fabric conditioning material in the composition is preferably at least 1% by weight of the composition, especially preferred from 1–75% by weight, generally from 2–25% by weight, especially preferred from 3–15% by weight of the composition.

The coactive material

The compositions according to the invention contain coactives being included in the dispersion of amphoteric fabric material and having an HLB of between 10.0 and 12.0. The composition may also contain a mixture of coactives. The mixture can contain one or more coactive materials having an HLB outside the range 10.0 to 12.0 provided the average HLB of the mixture of coactives is within the range 10.0 to 12.0. Preferably the HLB of the coactive or mixture of coactives is within the range 10.5 to 11.5. The HLB scale is a known measure of hydrophilic-lipophillic balance in any compound. HLB values referred to herein are taken from Armour Hess Product Bulletin 1978, AKZO Chemie bv Amersfoort, The Netherlands or from McCutcheon's Emulsifiers and Detergents, International Edition 1985.

The coactive may be a cationic, nonionic or semi-polar surfactant. Preferred cationic surfactants are water-soluble cationic materials such as water-soluble quaternary ammonium salts and imidazolinium salts. Such materials are available from Armour Chemicals under the Arquad Trade Mark. These commercially available cationic materials often contain isopropanol or similar solvents as an impurity. Such solvents are usually removed before products containing the cationic materials are prepared.

Suitable preferred nonionic surfactants include alkoxylated esters of a mono- or polyhydric alcohol, such as the ethoxylated sorbitan ester of the Tween series or the sorbitan esters of the Span series (Span and Tween are Trade Marks of Atlas Chemical Industries), and nonyl phenol ethoxylated with an average of 6 ethylene oxide groups per molecule.

Suitable semi-polar surfactants include amine oxides. Amine oxide surfactants suitable as coactives differ from those suitable as amphoteric fabric treatment materials by being more water soluble and therefore having a higher HLB. Suitable amine oxide surfactants are commercially available, such as Aromox DMHTD/W (Aromox is a Trade Mark of Armour Chemicals).

Particularly preferred is the use of water-soluble cationic materials as co-active. Especially preferred is the use of Arquad 2C, a dicoco-dimethyl ammonium chloride compound ex Atlas Chemie. This material has a HLB of 11.4.

The level of coactive material is such that the weight ratio of amphoteric fabric treatment material to coactive material is between 5:1 and 50:1 more preferred between 10:1 and 50:1 most preferred between 10:1 and 30:1.

Optional ingredients

The final product optionally contains one or more further ingredients.

Such optional ingredients include water-insoluble cationic fabric treatment materials. These materials have a solubility in water at pH 2.5 and 20° C. of less than 10 g/l. Highly preferred materials are cationic quaternary ammonium salts having two $C_{12-24}$ hydrocarbyl chains.

Well-known species of substantially water-insoluble quaternary ammonium compounds have the formula

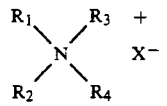

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenate tallow hydrocarbyl) dimethyl ammonium methyl sulfate; dishexadecyl diethyl ammonium chloride; di(coconut hydrocarbyl) dimethyl ammonium chloride. Ditallow dimethyl ammonium chloride, di(hydrogenated tallow hydrocarbyl) dimethyl ammonium chloride, di(coconut hydrocarbyl) dimethyl ammonium chloride and di(-coconut hydrocarbyl) dimethyl ammonium methosulfate are preferred.

Other preferred cationic compounds include those materials as disclosed in EP 239,910, which is included herein by reference.

Other preferred materials are the materials of formula

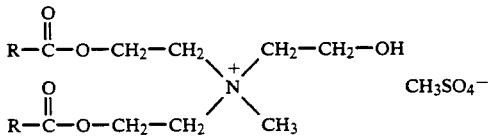

R being tallow,
which are available from Stepan under the tradename Stepantex VRH 90 and

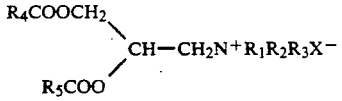

where $R_1$,$R_2$ and $R_3$ are each alkyl or hydroxyalkyl groups containing from 1 to 4 carbon atoms, or a benzyl group.

$R_4$ and $R_5$ are each an alkyl or alkenyl chain containing from 11 to 23 carbon atoms, and $X^-$ is a water soluble anion, substantially free of the corresponding monoester.

Another class of preferred water-insoluble cationic materials are the hydrocarbylimidazolinium salts believed to have the formula:

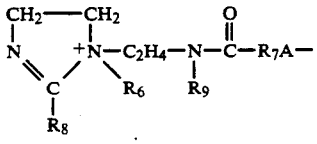

wherein $R_6$ is an hydrocarbyl or hydroxylhydrocarbyl group containing from 1 to 4, preferably 1 or 2 carbon atoms, $R_7$ is an hydrocarbyl group containing from 8 to 25 carbon atoms, $R_8$ is an hydrocarbyl group containing from 8 to 25 carbon atoms and $R_9$ is hydrogen or an hydrocarbyl containing from 1 to 4 carbon atoms and $A^-$ is an anion, preferably a halide, methosulfate or ethosulfate.

Preferred imidazolinium salts include 1-methyl-1-(tallowylamido-) ethyl -2-tallowyl- 4,5-dihydro imidazolinium methosulfate and 1-methyl-1-(palmitoylamido)ethyl-2-octadecyl-4,5-dihydro-imidazolinium chloride. Other useful imidazolinium materials are 2-heptadecyl-1-methyl-1-(2-stearylamido)-ethyl-imidazolinium chloride and 2-lauryl-1-hydroxyethyl-1-oleyl-imidazokinium chloride. Also suitable herein are the imidazolinium fabric softening components of U.S. Pat. No. 4 127 489, incorporated by reference.

Nonionic materials, such as fatty acids, lanolin, glycerol monostearate, fatty alcohols and esters of fatty acids with short chain monohydric or polyhydric alcohols may also be included.

Other optional ingredients include further fabric softening agents, antistatic agents, viscosity modifiers, fatty acids, germicides, fluorescers, perfumes (including deodorising perfumes), electrolytes, colourants, antioxidants, silicones, bleaches, bleach precursors, anti-yellowing agents, hydrocarbons, enzymes, ironing aids etc, all in conventional amounts.

When present the optional ingredients, especially the water-insoluble cationic fabric treatment materials, may at least partly be incorporated into a second dispersed phase in addition to the first dispersed phase of amphoteric material and co-active. If this is the case then the ingredients incorporated in the second dispersed phase are not considered as co-active and therefore not used in the calculation of the HLB or the weight fraction of the co-actives.

The fabric treatment composition

The final fabric treatment composition will preferably comprise:

1–75% amphoteric fabric treatment material
0.02–15% co-active material
0–75% cationic water-insoluble fabric treatment material
0–25% nonionic water-insoluble fabric treatment material
0–25% further fabric softening agents
0–25% antistatic agents
0–25% viscosity modifyers
0–25% fatty acid materials
0–25% hydrocarbon materials
0–25% silicones
0–1% germicides
0–1% fluorescers
0–2% perfumes
0–5% electrolytes e.g. $CaCl_2$
0–2% colourants
0–5% antioxidants e.g. citric acid
0–2% bleaches or bleach precursors e.g. hydrogen-peroxide
0–1% anti-yellowing agents
0–1% enzymes
0–5% ironing aids.
Less than 15% solvents (e.g. isopropanol).

More preferably the fabric treatment composition will comprise:

1–15% amphoteric fabric treatment material
0.02–3% co-active material
1–15% cationic water-insoluble fabric treatment material up to 10% of the other optional ingredients mentioned above.

Preferably the weight ratio of amphoteric water-insoluble material to cationic water-soluble material is between 5:1 and 1:5 more preferred from 2:1 to 1:2.

Preferably the pH of the composition is less than 6.0, more preferred between 2.0 and 5.5. If necessary the pH may be regulated to the desired value by the addition of acid or alkaline ingredients. The viscosity of the product is preferably less than 200 cPs at 110 $S^{-1}$ as measured by using a Haake viscometer.

Preparation of the ingredients and compositions

The amphoteric fabric conditioning materials for use in a fabric treatment composition according to the present invention are either commercially available or may be obtained by well-known chemical synthesis routes.

Amphoteric fabric conditioning materials which are commercially available include Rewoquat V1767 (ex Rewo) which is believed of ampholytic nature (group i) wherein $R_1$ and $R_2$ are hardened tallow and $R_4$ is $(CH_2)_2$, X is $—COO^-$.

Other commercial available materials are amine oxide materials (group v) such as, di tetradecyl amine oxide and di-coco-methyl amine oxide.

The amphoteric fabric conditioning materials may also be synthesised by any standard techniques for the preparation of tertiary or quaternary ammonium compounds. Suitable synthesis routes for such compounds are for given in The Chemistry of the Amino Group, First Edition, Wiley Interscience 1988 (London) and Advanced Organic Chemistry, Reactions, Mechanisms and Structure 3rd Edition, John Wiley and Sons 1985 (Chichester).

Other materials such as the co-actives and the cationic water-insoluble fabric treatment materials are commercially available.

The composition of the invention may usefully be prepared by forming a molten mixture of the amphoteric material and the co-active and dispersing this mixture in water. The water may be pre-heated to the temperature of the molten mixture.

We have also surprisingly discovered however that liquid aqueous fabric conditioning compositions containing a cationic water-insoluble fabric softener in addition to the amphoteric material and the co-active exhibit improved properties, such as an improvement in softness benefit for fabrics treated with the products, when they are prepared by a specific method.

This specific method for preparing a aqueous liquid fabric conditioning composition which comprises a cationic water-insoluble fabric softener and an amphoteric material and an co-active suspended in an aqueous base, is characterised by the steps of (i) dispersing the cationic water-insoluble fabric softener in water to form a first aqueous dispersion.

(ii) dispersing the amphoteric material and the coactive in water to form a second aqueous dispersion, and (iii) combining the first and second dispersion.

When the two dispersions are mixed, it is convenient that they should be of approximately the same volume. This is not essential however and successful results can be obtained if the two dispersions are prepared with such a concentration that mixing at a volume ratio of 1:10 to 10:1 will lead to the desired final product. After mixing, further water substantially free of both the water-insoluble cationic fabric softener and the amphoteric material and the co-active may be added if desired.

In use, the product prepared according to the invention is added to a large volume of water to form a rinse liquor with which the fabrics to be treated are contacted. Preferably the active level in the rinse liquor is from 10 to 1000 ppm. For optimum performance, the level of cationic fabric softener in the rinse liquor should be greater than the level of anionic surfactant carried over from the wash step in a fabric laundering process.

The invention will now be further illustrated in the following non-limiting examples.

EXAMPLE I

A molten premix was prepared containing 5.5% dihardened tallow methyl amine oxide and a co-active at a weight ratio of amine oxide to co-active of 10:1. This premix, at a temperature of 80° C., was added to demineralised water at the same temperature and agitated vigorously while the temperature fell to 50° C. This was followed by gentle agitation while the temperature fell to room temperature. The stability of the composition was judged visually after 24 hours. Products were rated as stable, borderline or unstable.

The coactives used, their HLB values and the results obtained are set out in the following table.

| Co-active | HLB | Stability |
|---|---|---|
| Arquad 2C[1] | 11.4 | Stable |
| Arquad 18[2] | 15.7 | Unstable |
| Arquad 2HT[3] | 9.7 | Unstable |
| Aromox DMMCD/W[4] | 18.7 | Unstable |
| Aromox M210[5] | >12 | Borderline |

[1]Trade Mark for dicocodimethyl ammonium chloride
[2]Trade Mark for hardened tallow trimethyl ammonium chloride
[3]Trade Mark for dihardened tallow dimethyl ammonium chloride.
[4]Trade Mark for dimethyl-coco amine oxide
[5]Trade Mark for didecyl methyl amine oxide The results show that if the compositions contain a coactive it should preferably have an HLB of between 10.0 and 12.0 to obtain stable products.

EXAMPLE 2

Example 1 was repeated except in this example a mixture of two coactives with different HLB values were used. These were Tween 20[6] (Trade Mark) HLB=16.7

Span 20[7] (Trade Mark) HLB=8.6

6- Trade Mark for a mixture of laurate esters and anhydrides, consisting predominantly of the monoester, condensed with approximately 20 moles of ethylene oxide.

7- Trade Mark for sorbitan laurate which is the monoester of lauric acid and hexitol anhydrides derived from sorbitol.

The mixtures used, their HLB values and the results obtained are set out in the following table.

| Span:Tween | HLB | Stability |
|---|---|---|
| 18:2 | 9.4 | Unstable |
| 14:6 | 11.0 | Stable |
| 12:8 | 11.8 | Borderline |
| 10:10 | 12.6 | Unstable |

Stable compositions can also be formed if the mixture of Span: Tween is replaced by other coactives such as nonyl phenol 6EO which has an HLB of 11.0.

This example also illustrates the preference for coactive materials of HLB value between 10.0 and 12.0.

EXAMPLE 3

Example 1 was repeated except in this example a mixture of 3 parts of Arquad 2HT and 1 part of Arquad 18 was used as the coactive. This mixture had an HLB value of 11.2. The product formed was stable.

The compositions containing dihardened tallow methyl amine oxide and either Arquad 2C, Span/-Tween (14:6), nonyl phenol 6EO or Arquad 2HT/Arquad 18 (3:1) were stable for at least a 1–2 week period.

EXAMPLES 4 AND 5

Example 1 was repeated except that in these examples dihardened tallow methyl amine oxide was replaced by ditetradecyl methyl amine oxide (Example 4) and a 50:50 mixture of dihardened tallow methyl amine oxide and dicoco methyl amine oxide (Example 5).

EXAMPLE 4

The co-actives used, their HLB values and the results obtained are set out in the following table

| Co-active | HLB | Stability |
|---|---|---|
| None | — | Unstable |
| Span/Tween 16/4 | 10.2 | Borderline |
| Span/Tween 14/6 | 11.0 | Stable |
| Arquad 2C | 11.4 | Stable |

EXAMPLE 5

The co-actives used, their HLB values and the results obtained are set out in the following table.

| Co-actives | HLB | Stability |
|---|---|---|
| None | — | Unstable |
| Span/Tween 16/4 | 10.2 | Borderline |
| Span/Tween 14/6 | 11.0 | Stable |
| Span/Tween 12/8 | 11.8 | Stable |
| Span/Tween 10/10 | 12.6 | Unstable |
| Arquad 2C | 11.4 | Stable |

The results demonstrate that if the compositions contain a co-active which has an HLB value of above 12.0, stable products are not formed. In contrast, if the co-active used has an HLB value of between 10.0 and 12.0 stable products can be formed.

EXAMPLE 6

The effect of the level of co-active on the softening performance of the composition was examined in this example.

In a laboratory scale tergotometer having a volume of 1 liter, a 25 g load of cotton terry towelling was washed at 50° C. with a commercially available washing powder product, UK Persil Automatic, at a dosage of 5 grams per liter. After separating off the wash liquor, the fabric load was rinsed twice in 1 liter of Wirral water (about 10° FH) at 25° C. 4ml of a test product according to the invention was added to the second rinse. After line drying, the fabric load was assessed for softness by a panel of experts.

Each tested product contained 2.63% of a mixture of dihardened tallow methyl amine oxide and Arquad 2C in various weight ratios incorporated in a first dispersion and 2,5% Arquad 2HT in a second dispersed phase.

Each test product was made as follows. A molten premix containing the dihardened tallow methyl amine oxide and Arquad 2C, at various weight ratios as listed below, was prepared by the method described in Example 1. A dispersion containing 5.25% of the active ingredients (dihardened tallow methyl amine oxide + Arquad 2C) was formed. The Arquad 2HT was heated to 70° C. and then added to water at 70° C. to form a second dispersion containing 5% active material. The two dispersions were combined together with low agitation at room temperature.

| Composition | Weight ratio dihardened tallow:Arquad 2C methyl amine oxide |
|---|---|
| A | 40:1 |
| B | 20:1 |
| C | 9.5:1 |
| D | 3.2:1 |
| E | 0.9:1 |

The results of the softness assessment in the presence of anionic carryover showed a preference for product B in the following order B>A>C>D>E.

EXAMPLE 7

Example 6 was repeated without pre-washing (i.e in the absence of anionic carryover) the fabric load. The products tested contained 2.5% Arquad 2HT and 2.63% of a mixture of the dihardened tallow methyl amine oxide and Arquad 2C in various weight ratios as given above in Example 6.

The results of the softness assessment again showed a preference for product B in the following order B>A>C>D>E.

EXAMPLE 8

This example was carried out to determine the softening performance of compositions containing dihardened tallow methyl amine oxide and either Arquad 2C or Span/Tween (14:6) as co-active. The method used was that described in Example 6.

The test product contained 5% dihardened tallow methyl amine oxide and 0.5% of the co-active. The results of the softness assessment, in the presence and absence of anionic carryover, showed a preference for the product containing Arquad 2C.

The softening performance of compositions containing a mixture of each of the above-mentioned test products with Arquad 2HT was also examined. The test product contained 2.5% Arquad 2HT, 2.5% dihardened tallow methylamine oxide and 0.25% co-active and was prepared as described in example 6. The effect of anionic carryover on the softening performance of each composition was also examined. In the presence of anionic carryover the better softening was generally obtained with nonionic co-active. However, in the absence of anionic carryover better softening was generally obtained with cationic co-actives. Nevertheless good softening was obtained with all products.

EXAMPLE 9

The softening performance of the following compositions in the presence of anionic carryover were examined by the method described in Example 6.

| Composition | Arquad 2HT | dihardened tallow methyl amine oxide | Arquad 2C |
|---|---|---|---|
| F | 5.00% | — | — |

-continued

| Composition | Arquad 2HT | dihardened tallow methyl amine oxide | Arquad 2C |
|---|---|---|---|
| G | — | 5% | 0.5% |
| H | 0.71% | 4.29% | 0.43% |
| I | 1.27% | 3.73% | 0.37% |
| J | 2.5% | 2.5% | 0.25% |

The results of the softening assessment in the presence of an anionic carryover showed a preference for product J in the order J>I>H>F>G.

These results show that an improvement in softening is achieved if a composition containing a mixture of Arquad 2HT, dihardened tallow methyl amine oxide and Arquad 2C is used compared to the softening achieved when either (i) Arquad 2HT or (ii) a mixture of dihardened tallow methyl amine oxide and Arquad 2C are used separately.

EXAMPLE 10

In a laboratory scale tergotometer with a volume of 1 liter, a 25 g load of cotton terrytowelling was washed at 50° C. with a commercially available fabric washing product, UK Persil Automatic. This was dosed at a level of 4 grams per liter. After separating off the wash liquor, the fabric load was rinsed twice in 1 liter of Wirral water (10° FH) at 25° C. to which 4 ml of a test product was added to the second rinse. After line drying the fabric load was assessed for softness by a panel of experts.

Each tested product contained 5% of active ingredient and 0.25% Arquad 2C as a co-active. The active ingredient comprised dihardened tallow methyl amine oxide and Arquad 2HT.

Product A was prepared by the following method. The amine oxide was heated to 80° C. with Arquad 2C and then added to water at 80° C. to form a dispersion. The cationic fabric softener was heated to 70° C. and then added to water at 70° C. to form a second dispersion. The two dispersions were combined together with low agitation of room temperature. Product B was prepared by the following method. The cationic fabric softener and the amine oxide were melted together and added hot to water at 80° C. The mixture was agitated for 1 minute and subsequently soniprobed for 10 minutes while still hot. Product C contained only 5% of the cationic fabric softener prepared as above.

The results of the softness assessment showed a preference for product A, in the order A>B>C.

Similar results are obtained when the amine oxide is (i) Aromox M2C (Trade Mark) which is a commercially available form of di-coconut hydrocarbyl methyl amine oxide, and (ii) behenyl dimethyl amine oxide.

Similar results can be obtained if the Arquad 2HT is replaced by an alternative cationic fabric softener or if the Arquad 2C is replaced by other co-actives, such as Arquad 18 (a commercially available form of hardened tallow trimethyl ammonium chloride).

EXAMPLE 11

The products tested in Example 1 were tested in washing machines. Bauknecht (Trade Mark) and Miele (Trade Mark) automatic washing machines were used. 3 kg of a mixed cotton and cotton/polyester fabric load were used. The load was washed using a 60° C. wash cycle with 90 g UK Persil Automatic in 20 liters hard water. 45 ml or 90 ml of each product was added to the final rinse.

In all cases the softness obtained from product A was preferred over that obtained from product B or product C. The order of preference was A>B>C.

EXAMPLE 12

Formulations given in the table below were prepared as follows. In formulation 12A dispersions containing the dihardened tallow methyl amine oxide/Arquad 2C and Arquad 2HT/hardened tallow fatty acid were prepared separately and then combined together at room temperature (see Example 3). Formulation 12B was prepared by the method described for 12A except that the fatty acid was absent. Formulation 12C was prepared by forming a molten premix of the components which was subsequently dispersed in water.

| Example No. | Weight Ratio of Arquad 2HT to Dihardened tallow methyl amine oxide to Arquad 2C to Hardened tallow fatty acid |
|---|---|
| 12A | 4:4:0.4:1 |
| 12B | 1:1:0.1:0 |
| 12C | 4:0:0:1 |

The compositions were tested as above. The results of the softness assessment showed a preference for product A in the order A>B>C. This example clearly shows the advantage of using the specific processing method of formulation 10A and 10B. As used herein, "°FH" with respect to water hardness is the molar concentration of free hard water ions $x10^{-4}$.

EXAMPLE 13

A composition containing 2.5% Arquad 2HT, 2.5% Rewoquat V1767 (dihardend tallow propion amine-chloride ex Rewo) and 0,25% Arquad 2C was prepared according to the method for product A of example 10, the product was tested by prewashing with UK Persil Automatic followed by rinsing in the present of the product as described in Example 6.

A second composition containing 5% Arquad 2HT as the sole fabric softening material was tested by the same method. The formulation containing Arquad 2HT and Rewoquat resulted in a slightly better softening than the formulation containing Arquad 2HT only.

EXAMPLE 14

Example 13 was repeated, now using a 2-(Diotadecyl methylammonio)-ethane sulphate prepared by the reaction of 1 mole of N-methyl dioctadecylamine with 1.05 mole ethylene sulphate. Both compounds were dissolved in butanone. The mixture was refluxed for 8H. On cooling a white precipitate was formed which was filtered washed with Lexane. Yield was approximately 93%

The formulation containing Arquad 2HT and amphoteric material resulted in slightly better softening than the formulation containing 2HT only.

I claim:

1. A fabric treatment composition comprising:

(1) water;

(2) from 1 to 75% by weight of one or more amphoteric compounds which compounds are substantially water insoluble in that the solubility of the compound when measure in water at a pH of 2.5 and at a temperature of 20° C. is less than 10 g/l and which compounds are selected from the group consisting of:

I ampholytes of the following formula:

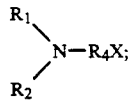

II hydrocarbyl betaines of the following formula:

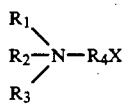

III hydrocarbylamino betaines of the following formula:

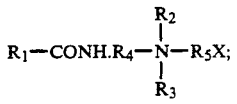

IV gliycinates or propionates of the following formula:

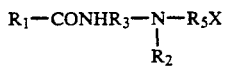

or

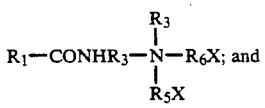

V tertiary amine oxides of the following formula:

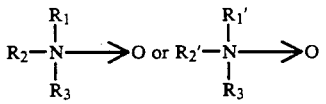

wherein $R_1$ and $R_2$ are $C_8$–$C_{25}$ hydrocarbyl chains $R_1'$ is $C_{16}$–$C_{50}$ hydrocarbyl chain $R_2'$ and $R_3$ are hydrocarbyl groups containing 1–4 carbons or a group $—(CH_2CH_2O)_nH$;

$R_4$, $R_5$, $R_6$ are $—(CH_2)n$;

n is an integer from 1–6; and

X is $SO_3$—, $SO_42$— or COO—; and (3) a second compound selected from the groups consisting of water soluble cationic surfactants, nonionic surfactants, amine oxides and mixtures thereof and wherein the compound or mixture of compounds have an HLB of between 10.0 and 12.0; the weight ratio of the amphoteric compound (2) to the second compound (3) being from 5:1 to 50:1.

2. A composition according to claim 1, wherein said substantially water insoluble amphoteric compound is a tertiary amine oxide having the formula;

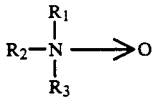

wherein $R_1$ and $R_2$ are $C_{14}$–$C_{25}$ hydrocarbyl chains and $R_3$ is a hydrocarbyl chain having 1–4 carbons or a group $—(CH_2CH_2O)_nH$.

3. A composition according to claim 1, wherein said substantially water insoluble amphoteric compound comprises from 3–15% by weight of the composition.

4. A composition according to claim 1, wherein the water soluble cationic surfactant is a water soluble quaternary or imidazolinium salt.

5. A composition according to claim 1, wherein the nonionic surfactant is used in a mixture of second compounds such that the mixture has an HLB of between 10.0 and 12.0 and said nonionic surfactant is an alkoxylated ester of a mono- or polyhydric alcohol.

6. A composition according to claim 1, wherein the nonionic surfactant is used in a mixture of second compounds such that the mixture has an HLB of between 10.0 and 12.0 and said nonionic surfactant is ethoxylated sorbitan.

7. A composition according to claim 1, wherein the substantially water insoluble amphoteric compound is a tertiary amine oxide and the second compound is a water soluble cationic compound.

8. A composition according to claim 1, wherein the amphoteric compound is ditallow methyl amine oxide and the water soluble cationic surfactant is dicocodimethyl ammonium chloride.

9. A composition according to claim 1, wherein the composition further comprises 1–25% of a cationic fabric treatment compound having the formula:

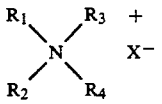

wherein $R_1$ and $R_2$ are hydrocarbyl groups having from about 12–24 carbons;

$R_3$ and $R_4$ are hydrocarbyl groups having 1–4 carbons; and

X is an anion selected from the group consisting of halide, methyl sulfate and ethyl sulfate radicals;

wherein said compound is substantially water insoluble in that the solubility of the compound when measured in water at a pH of 2.5 and at a temperature of 20° C. is less than 10 g/l.

* * * * *